US005338232A

United States Patent [19]

Bernier

[11] Patent Number: 5,338,232

[45] Date of Patent: Aug. 16, 1994

[54] ELECTRICAL INTERCONNECTION DEVICE

[76] Inventor: Raymond Bernier, 29 Avenue Foch, 94300 Vincennes, France

[21] Appl. No.: 982,517

[22] Filed: Nov. 27, 1992

[30] Foreign Application Priority Data

Nov. 29, 1991 [FR] France ..... 91 14820

[51] Int. Cl.[5] ..... H01R 13/40

[52] U.S. Cl. ..... 439/733

[58] Field of Search ..... 439/84, 444, 733, 741

[56] References Cited

U.S. PATENT DOCUMENTS

| | | | |
|---|---|---|---|
| 3,103,400 | 9/1963 | Gaither | 439/733 |
| 3,122,605 | 2/1964 | Zaugg | 439/733 |
| 3,325,770 | 6/1967 | Hammell et al. | 439/733 |
| 3,557,446 | 1/1971 | Charschan | 439/84 |
| 3,858,159 | 12/1974 | Worth | 439/733 |
| 4,469,389 | 9/1984 | Grabbe et al. . | |

FOREIGN PATENT DOCUMENTS

| | | |
|---|---|---|
| 0431566 | 6/1991 | European Pat. Off. . |
| 8704568 | 7/1987 | World Int. Prop. O. . |

*Primary Examiner*—P. W. Echols

*Attorney, Agent, or Firm*—Steinberg, Raskin & Davidson

[57] ABSTRACT

An electrical interconnection device comprising a body of elastic insulating material through which extends at least one duct and at least one conducting element inserted into the duct to establish therein an electrical contact with another conducting element whereas a bearing shoulder formed between a rod and a head of the conducting element is applied against the body in the vicinity of the duct and prevents the full penetration of the conducting element into the duct, the device being usable in particular in electronic mountings.

14 Claims, 4 Drawing Sheets

FIG_10
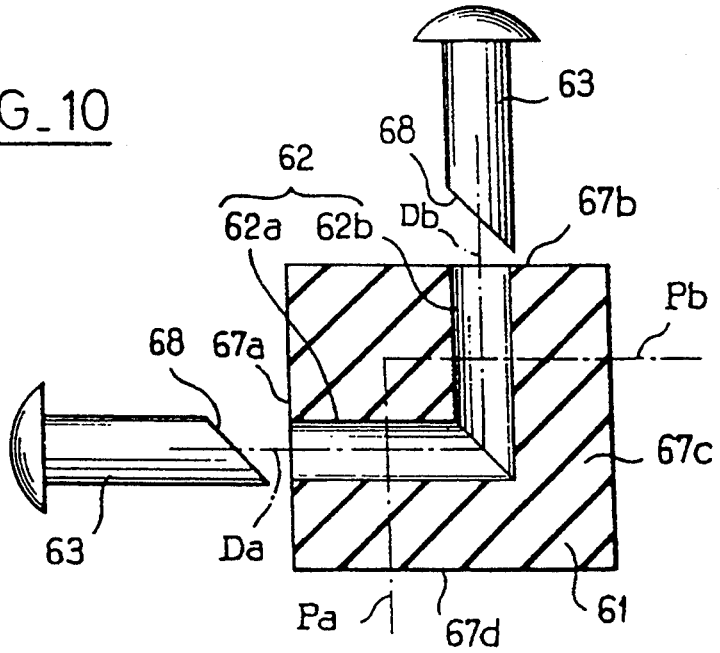
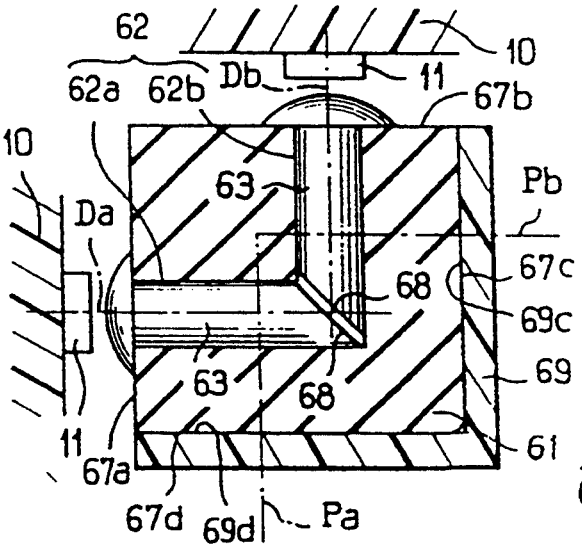
FIG_11
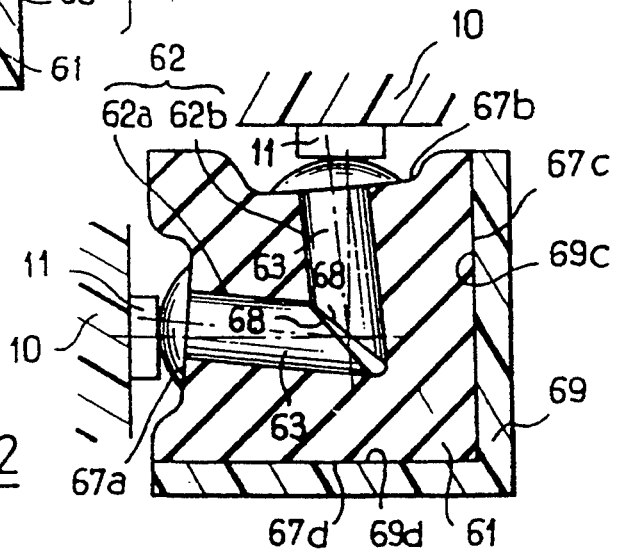
FIG_12

ELECTRICAL INTERCONNECTION DEVICE

BACKGROUND OF THE INVENTION

The present invention relates to an electrical interconnection device.

This type of device is intended to provide contacts between different electrical components or conductors. It may for example be a part of an electronic mounting or be integrated into a connector.

These devices usually comprise a rigid insulating support in which are mounted conducting elements providing the desired contact. One is seeking two properties to guarantee the safety of the contact: the pressure and the attendance. The pressure is bound to the bearing force between the contact surfaces and the attendance is the capability of the contact to maintain itself during some displacement of the conducting elements.

To obtain these two properties the conducting elements of the device are in general mounted with elasticity with respect to the rigid insulating support. A first possibility consists in interposing elastic members such as springs between the conducting elements and the support. These elastic members increase the number of parts hence the cost of the device. They may moreover give rise to mounting problems when the device is of small size. Another possibility consists in imparting elastic properties to the conducting elements themselves. But these elastic properties are difficult to provide in a reliable manner when the conducting elements are of small size. Furthermore these elastic properties are impairing themselves after several connections and disconnections of the components. The object of the present invention is to remove the inconveniences hereabove and to simplify the structure of the known interconnection devices.

SUMMARY OF THE INVENTION

The invention thus proposes an electrical interconnection device, characterized in that it comprises a body of insulating elastic material through which extends at least one duct and at least one conducting element inserted into the duct to there establish an electrical contact with another conducting element and in that bearing means applied against the body in the vicinity of the duct prevent the complete penetration of the conducting elements into the duct.

Thus the elastic maintaining of the contact between the conducting elements is provided by the insulating body of the device. If the components electrically interconnected by the device are slightly displacing themselves, the bearing means elastically deform the body in the vicinity of the duct, thereby reinforcing the contact pressure. The portion of the conducting element located outside of the duct may have a shape adapted to those of the components to be interconnected, for example a bulged shape if it is intended to bear against the conducting areas of a printed or integrated circuit.

In a preferred version of the device according to the invention, the conducting element(s) inserted into the duct elastically deform(s) the duct, preferably the cross-section of the duct.

This device allows the conducting elements to be maintained in the body after the assembling of the device and before associating the device with the components to be interconnected.

BRIEF DESCRIPTION OF THE DRAWINGS

For a better understanding of the invention, reference is made to the following description, taken in connection with the accompanying drawings, in which:

FIGS. 10 to 12 are views similar to those of FIGS. 1 to 3 of a fourth embodiment of the invention.

DESCRIPTION OF THE EMBODIMENTS

Figure 1:
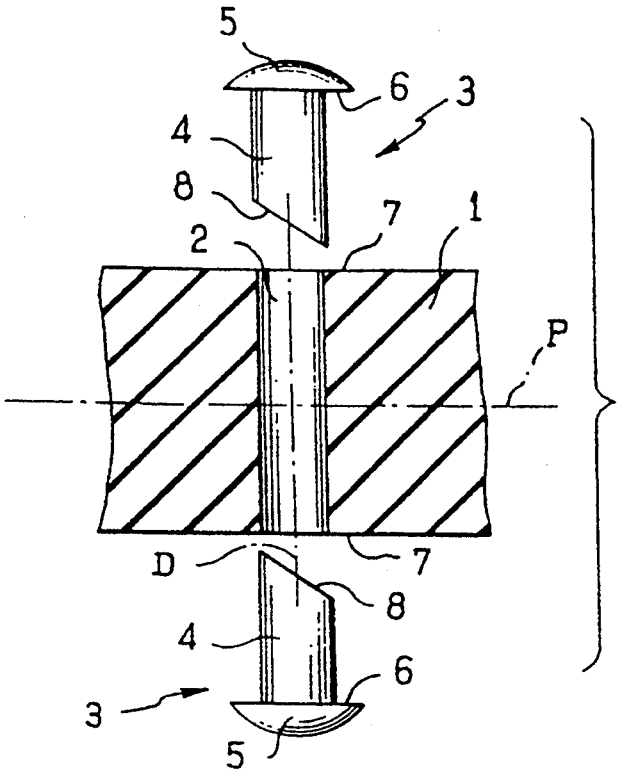
FIG. 1 is an exploded view of a device according to the invention.

With reference to FIG. 1, a device according to the invention comprises a body 1 of insulating elastic material. The body 1 may for example be a plate of silicone-based elastomer material having a thickness of the order of a few millimeters. One or several rectilinear ducts 2 having a circular section for example are extending through the body 1 .

Figure 2:
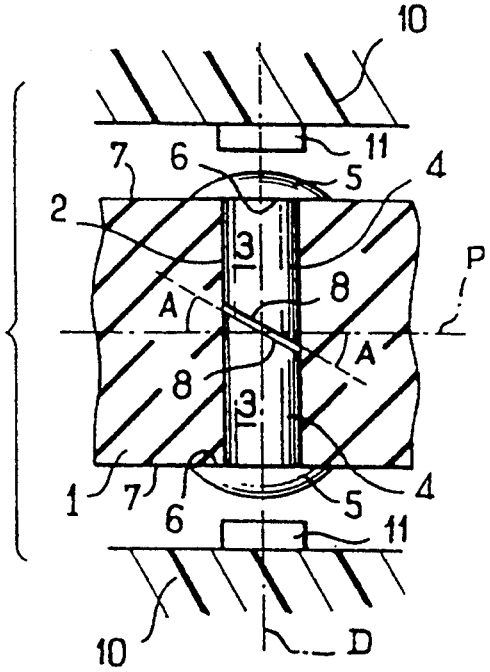
FIG. 2 is a view in section of the device of FIG. 1 after assembly.
Figure 3:
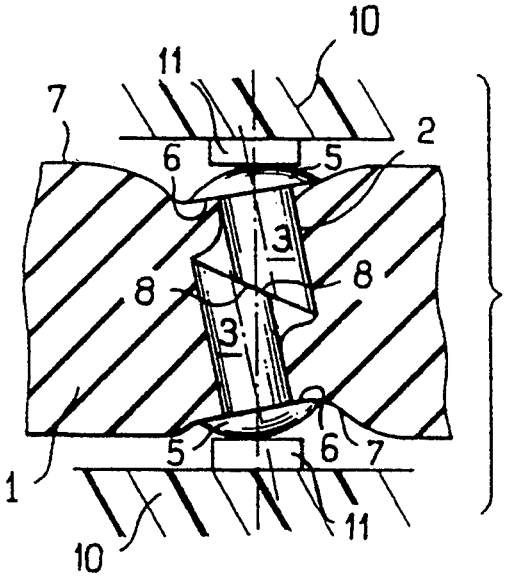
FIG. 3 is a view in section of the device of FIGS. 1 and 2 operation.

The device shown on FIGS. 1 to 3 comprises two conducting elements 3 of metal which are inserted into the duct 2 through two opposite faces of the body 1. In the example shown both conducting elements 3 have identical structures. They comprise each one a rod 4 penetrating into the duct 2 and a dished head 5 remaining outside of the duct. A shoulder 6 is formed between the rod 4 and the head 5. When the conducting elements 3 are inserted into the duct 2, the shoulders 6 are caused to bear against the surface 7 of the body 1 in the vicinity of the duct 2.

The rod 4 of each conducting element comprises at its end opposite to the head 5, a contact surface 8 inclined with respect to the direction of the rod 4. When the conducting elements 3 are inserted into the duct 2, their respective contact surfaces 8 are parallel with each other and form an angle A with the plane P perpendicular to the direction D of the duct 2 (FIG. 2). Thus when the conducting elements 3 inserted into the duct are pushed axially towards each other,they tend to slide along their respective contact surfaces 8 while maintaining the contact between these two surfaces.

As FIG. 1 shows it, the rod 4 of each conducting element 3 has a cross-section greater than that of the duct 2 when the conducting elements 3 are not inserted therein. Thus the presence of the conducting elements 3 in the duct 2 is widening the duct 2, thereby keeping in place the conducting elements 3 after the assembly of the device (FIG. 2).

On FIGS. 2 and 3 one has shown the components 10 interconnected by means of the device. In the example shown, the components are interconnected through the medium of contact formations 11 deposited upon their surfaces. The components 10 may for example be integrated or printed circuits. In the operating position shown on FIG. 3, the contact formations 11 are applied against the dished heads 5 of the conducting elements 3 with an axial pressure. This axial pressure elastically deforms the body 1 through the medium of the bearing shoulders 6 of the conducting elements 3. Both conductors would offset themselves with respect to each other. This still further deforms the duct. The tendency of the duct to return to its rest shape ensures the contact pressure between the contact surfaces 8. The property of attendance of the contacts results from the inclination of the contact surfaces 8 with respect to the plane P transverse to the direction D of the duct 2. If the components 10 are slightly displacing themselves in the axial direction, the conducting elements 3 are sliding with respect to one another along their respective contact surfaces 8 while maintaining the electrical contact.

The contact pressure may be adjusted to some extent by adapting the spacing of both components 10 to be interconnected or in the case where this spacing is imposed by adapting the thickness of the elastic body 1 and the lengths of the conducting elements 3. One may also vary the contact pressure by modifying the modulus of elasticity of the material of the body 1.

Figure 4:
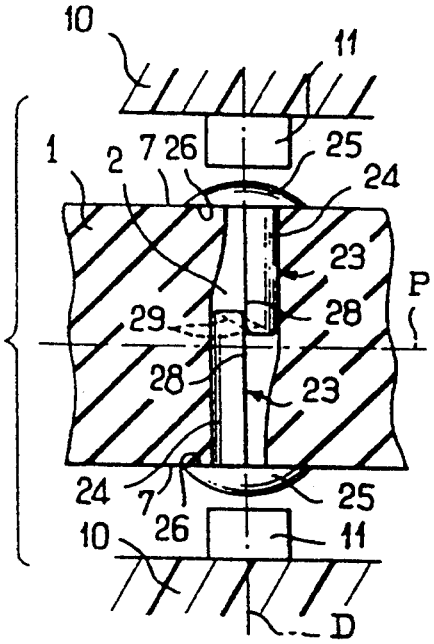
FIGS. 4 and 5 are views in section similar to those of FIGS. 2 and 3 of a second embodiment of the invention.
Figure 5:
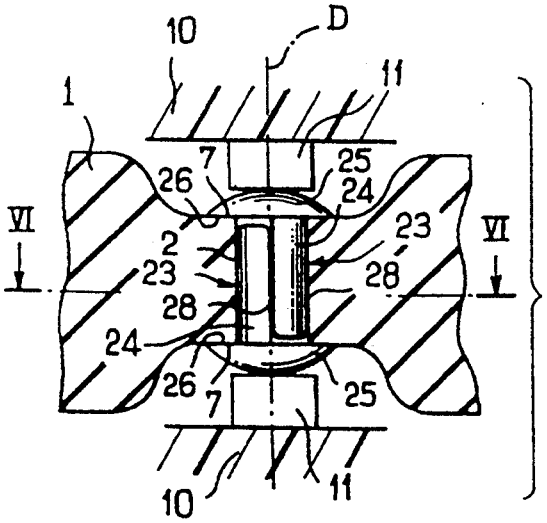
Figure 6:
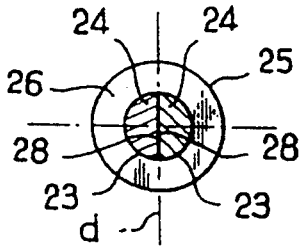
FIG. 6 is a view in section of the conducting elements of the embodiment of FIGS. 4 and 5, taken along the plane VI—VI shown on FIG. 5.

The exemplary embodiment illustrated on FIGS. 4 to 6 differs from that illustrated on FIGS. 1 to 3 by the shape of the conducting elements 23. The latter also comprise a rod 24, a dished head 25 and a bearing shoulder 26 formed between the rod 24 and the head 25. In cross-section (FIG. 6), each rod 24 has the shape of a half circle defined by a diametral line d extending along the contact surfaces 28 which are flat. When they are joined together, the rods 24 form in cross-section a circle with a diameter greater than that of the duct 2. Thus when one inserts both conducting elements 23 into the duct 2, the latter are widening the duct 2 as shown on FIG. 4. Thus the radial elastic clamping of the duct upon the conducting elements 23 provides the contact pressure between the contact surfaces 28. The condition of attendance is fulfilled since this pressure maintains itself when the surfaces 28 are axially gliding upon each other. To facilitate the mutual engagement of the conducting elements 23 upon their insertion into the duct 2, one may give them bevelled ends as shown in dashes on FIG. 4.

The contact surfaces 28 of the conducting elements 23 are parallel to the direction D of the duct 2, i.e. they form a right angle with respect to the plane P perpendicular to the direction D, thereby guaranteeing a good attendance of the contact.

Figure 7:
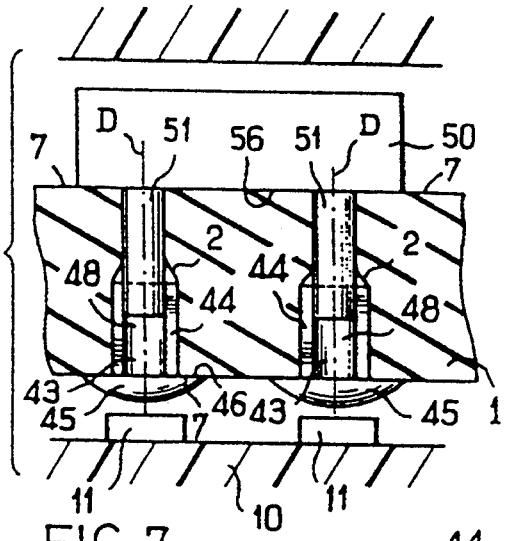
FIGS. 7 to 9 are views in section similar to those of FIGS. 4 to 6 of a third embodiment of the invention, the view of FIG. 9 being taken along the plane IX—IX shown on FIG. 8.
Figure 8:
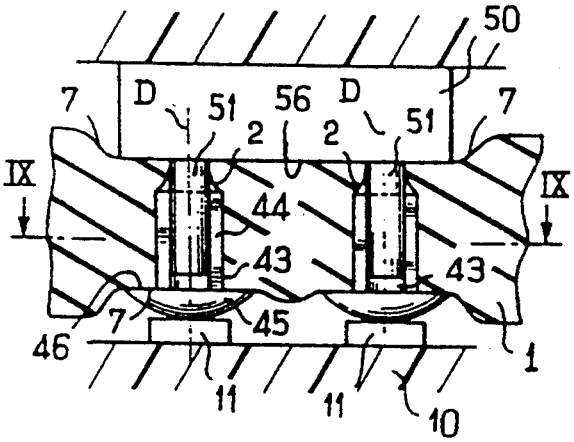
Figure 9:
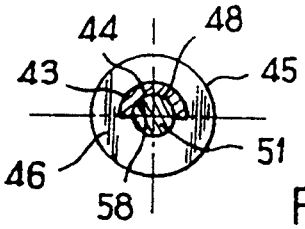

FIGS. 7 to 9 illustrate another embodiment of the invention usable when one of the components 50 to be connected is a component with a pin 51. On FIGS. 7 to 9, one has shown by way of example two pins 51 of cylindrical shape, projecting perpendicularly from a surface 56 of the component 50. The device comprises a body 1 similar to that described for the foregoing exemplary embodiments and for each pin 51, a conducting element 43 of metal. The body 1 comprises rectilinear ducts 2 the sections of which are close to those of the pins 51 and the spacings of which are corresponding to those of the pins 51 .

The conducting elements 43 comprise a rod 44, a head 45 and a bearing shoulder 46 formed between the rod 44 and the head 45. The rod 44 has a semi-cylindrical shape the internal diameter of which corresponds to that of one pin 51 and the external diameter of which is slightly greater than that of the duct 2. The contact surface 58 of the conducting pin 51 is defined by one side of the cylindrical shape of the pin 51. The contact surface 48 of the conducting element 43 has a concave shape conforming to the convex shape of the contact surface 58 of the pin 51. The contact surface 48 is defined within the rod 44 by surface lines parallel to the direction D of the duct 2.

To assemble the device illustrated on FIGS. 7 to 9, one inserts at first the conducting elements 43 into the corresponding ducts 2, and then one inserts the conducting pins 51 of the component 50 through the opposite face of the body 1 so that the ends of the pins 51 are coming into contact with the inside of the rods 44 (FIG. 7). Then one urges towards each other the component with pins 50 and the component with conducting formations 10, the pins 51 are sliding along the rods 44 of the conducting elements 43. The contact surfaces 48, 58 are maintained against each other by the elastic force generated by the deformation of the body 1 resulting on the one hand from the bearing of the shoulders 46 upon the surface 7 of the body 1 in the vicinity of the ducts 2 and on the other hand from the bearing of the surface 56 of the component 50 upon the opposite surface 7 of the body 1. In the embodiment of the invention illustrated on FIGS. 10 to 12, through the body 61 of insulating elastic material is extending a duct 62 consisting of two rectilinear portions 62*a*, 62*b* forming therebetween an angle which in the example shown is equal to 90° . The rectilinear portions 62*a*, 62*b* of the duct 62 are opening on two adjacent surfaces 62*a*, 62*b* of the body 61.

Into each rectilinear portion 62*a*, 62*b* of the duct is inserted a conducting element 63 having the same structure as the conducting element 3 of the embodiment illustrated on FIGS. 1 to 3. The rod of the conducting element 63 has a diameter slightly greater than that of the corresponding duct portion. The contact surface 68 of a conducting element 63 forms an angle of about 45° with the plane Pa, Pb perpendicular to the direction Da, Db of the corresponding duct portion 62*a*, 62*b*. Thus the contact surfaces 68 of both conducting elements 63 are practically parallel to each other when the device is assembled (FIG. 11). The electrical contact between the conducting elements 63 is established by the contact surfaces 68 at the intersection between both rectilinear portions 62*a*, 62*b* of the duct 62.

The device illustrated on FIGS. 10 to 12 is used to interconnect components 10 having conducting strips 11 which are located in planes perpendicular to each other. To apply the heads of the conducting elements against the contact formations 11, one may provide a rigid square-shaped support 69 having two surfaces 69*c*, 69*d* bearing against two surfaces 67*c*, 67*d* of the body 61, opposite to the surfaces 67*a*, 67*b*, respectively.

Figure 13:
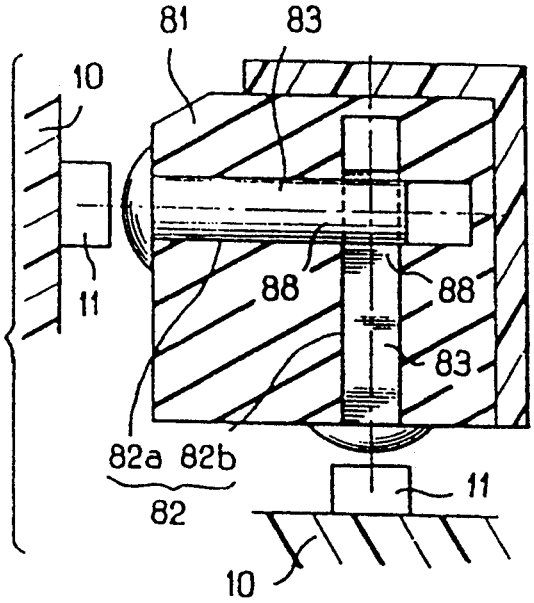
FIGS. 13 to 15 are Figures similar to those of FIGS. 4 to 6 of a fifth embodiment of the invention, the view of FIG. 15 being taken along the plane XV—XV shown on FIG. 14.
Figure 14:
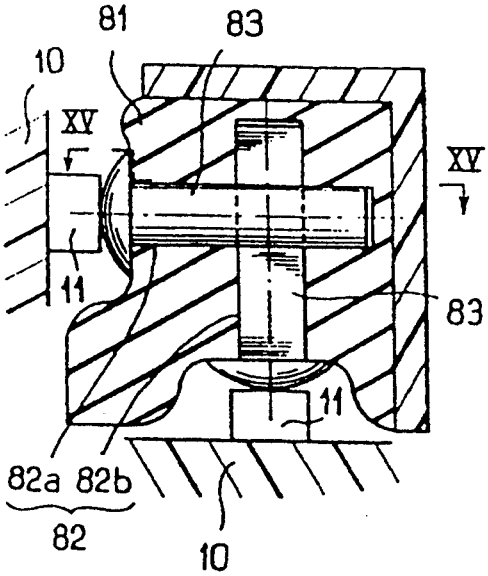
Figure 15:
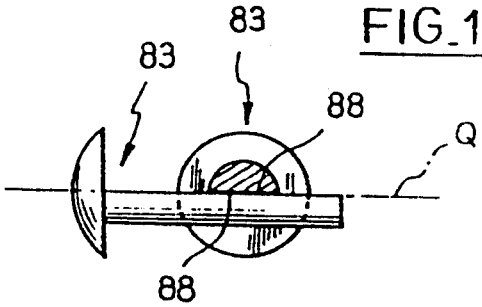

In the embodiment illustrated on FIGS. 13 to 15, the conducting elements 83 are identical with those of the embodiment of FIGS. 4 to 6. The body 81 of elastic insulating material of the embodiment of FIGS. 13 to 15 differs from the body 61 of the embodiment of FIGS. 10 to 12 in that the rectilinear portions 82*a*, 82*b* of the duct 82 are extending beyond the intersection between these two rectilinear portions. The conducting elements 83 are inserted into the rectilinear portions 82*a*, 82*b* of the duct so that their respective contact surfaces 88 are located in the plane Q (FIG. 15) defined by both directions of the rectilinear portions 82*a*, 82*b* of the duct (plane of FIGS. 13 to 14).

Figure 16:
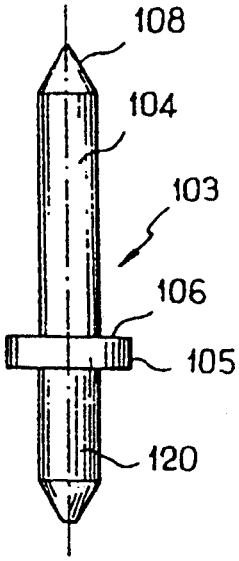
FIG. 16 is a plan view of an alternative embodiment of a conducting element usable in the device according to the invention.

FIG. 16 illustrates an alternative embodiment of a conducting element 103 usable in the device when a component to be interconnected comprises holes intended to receive contact pins. The conducting element 103 comprises a rod 104 and a head 105, a bearing shoulder 106 being formed between the rod 104 and the head 105. On the side opposite to the shoulder 106, the head 105 comprises a pin 120 intended for the connection to the component to be interconnected.

In the example shown on FIG. 16, the rod 104 of the element 103 has a conical end 108 on the side opposite to the head 105. Such a pointed shape of the end 108 facilitates the insertion of the conducting element 103 into a duct of smaller section as in the example of FIGS. 1 to 3 and 10 to 12. Moreover this pointed shape may allow to make the duct by driving the conducting elements 103 into the massive elastic body, the pointed end 108 perforating the material of the body to form the duct which then behaves as the preformed duct 2, 62, 82 previously described.

Figure 17:
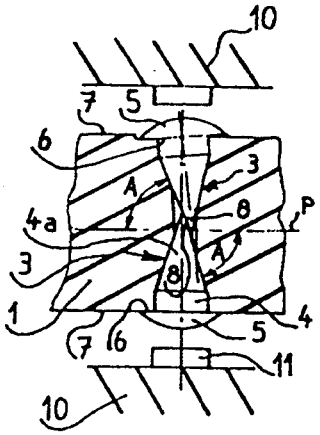
FIGS. 17 and 18 show a variant of the embodiment shown on FIGS. 2 and 3.
Figure 18:
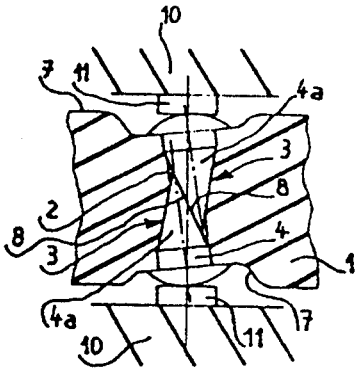

FIGS. 17 and 18 show a variant of the embodiment of the device shown on FIGS. 1 to 3. According to this variant the rod 4 of each one of both identical conducting elements 3 comprises a cylindrical portion extended by a conical end 4*a*. When the conducting elements 3 are inserted into the duct 2, their respective contact surfaces 8 formed by the conical ends 4*a* are parallel to each other and form an angle A with the plane P (FIG. 17). In this way when the conducting elements 3 inserted into the duct 2 are axially pushed towards each other, they tend to slide along their respective contact surfaces 8 while maintaining the contact between these two surfaces. The device according to this variant is indeed the best embodiment and gives full satisfaction as to the pressure and attendance properties of the contacts.

One has described several possible embodiments of the invention but one will understand that various modifications may be brought to these examples without departing from the scope of the invention.

Thus the body of elastic material may assume various shapes according to the number of interconnections to be provided and the geometry of the components to be interconnected. An advantage of making the body from elastic material is that one may give it a shape providing the fluid-tightness between the components to be interconnected.

The device according to the invention may have various applications. It may for example be inserted into an electronic mounting to interconnect several integrated or printed circuits. It may also be inserted into a connector to provide the latter with good contact pressure properties of attendance and possibly of fluid-tightness.

What is claimed is:

1. An electrical interconnection device comprising:

a body of insulating elastic material through which extends at least one duct, said duct having two opposing ends;

a pair of conducting elements inserted into said opposing ends of said duct, each of said conducting elements including a rod provided with a contact surface at one end and a head at an opposing end, and a shoulder located between said contact surface and said head of said rod, said shoulder of each of said conducting elements bearing against said elastic body at a location adjacent to said duct to prevent full insertion of said conducting elements into said duct and to allow said head of each of said conducting elements to be situated outside of said duct, said conducting elements being under an axial pressure pressing the same against said elastic body so that said shoulder of each of said conducting elements elastically deforms said elastic body and a continuous electrical contact is made between said contact surface of each of said conducting elements.

2. The device of claim 1, wherein said head of said conducting element has a dome shape on a side opposite to said shoulder of said conducting element and is in electrical contact with a component, said component exerting said axial pressure upon said conducting element.

3. The device of claim 1, wherein said head of said conducting element comprises a pin on a side opposite to said shoulder of said conducting element and is in electrical contact with a component, said component exerting said axial pressure upon said conducting element.

4. The device of claim 1, wherein said duct is substantially rectilinear and said contact surfaces of said conducting elements situated within said duct, form an angle with a plane perpendicular to the direction of said duct.

5. The device of claim 4, wherein said contact surfaces of said conducting elements have a conical shape.

6. The device of claim 1, wherein said duct is substantially rectilinear and said contact surfaces of said conducting elements inserted within said duct are substantially parallel to the direction of said duct.

7. The device of claim 6, wherein said contact surface of the first conducting element inserted within said duct has a concave shape defined by surface lines substantially parallel to the direction of said duct and conforming to a complementary convex shape of said contact surface of the second conducting element inserted within said duct.

8. The device of claim 4, wherein each of said conducting elements inserted within said duct has a cross-section greater than a cross-section of said duct, said cross-section of said duct being elastically deformed by application of said axial pressure, so as to maintain said rod of said conducting elements within said elastic body.

9. The device of claim 1, wherein said duct comprises two rectilinear portions defining an angle therebetween, each of said conducting elements being inserted into each of said rectilinear portions of said duct, said electrical contact between said contact surfaces of said conducting elements being established at an intersection of both rectilinear portions of said duct.

10. The device of claim 9, wherein said contact surface of each of said conducting elements inserted within each of said rectilinear portions of said duct, defines an angle with a plane perpendicular to the direction of said rectilinear portion of said duct.

11. The device of claim 10, wherein said contact surfaces of said conducting elements inserted within said duct are substantially parallel to said plane defined by both directions of said rectilinear portions of said duct.

12. An electrical interconnection device comprising:

a body of insulating elastic material through which extends at least one duct, said duct having two opposing ends;

a pair of conducting elements inserted into said opposing ends of said duct, each of said conducting elements including a rod provided with a contact surface at one end and a head at an opposing end, and a shoulder located between said contact surface and said head of said rod, said shoulder of each of said conducting elements bearing against said elastic body at a location adjacent to said duct to prevent full insertion of said conducting elements into said duct and to allow said head of each of said conducting elements to be situated outside of said duct; and a pair of components arranged on opposite ends of said duct for producing an axial pressure upon each of said conducting elements inserted within opposing ends of said duct to thereby allow said shoulder of each of said conducting elements to elastically deform said elastic body and to allow a continuous electric contact to be made between said contact surface of each of said conducting elements.

13. The device of claim 12, wherein said components comprise an integrated or printed circuit.

14. An electrical interconnection device comprising:

a body of insulating elastic material through which extends at least one duct, said duct having two opposing ends;

a pair of conducting elements inserted into said opposing ends of said duct, each of said conducting elements including a rod provided with a contact surface at one end and a head at an opposing end, and a shoulder located between said contact surface and said head of said rod, said shoulder of each of said conducting elements bearing against said elastic body at a location adjacent to said duct to prevent full insertion of said conducting elements into said duct and to allow said head of each of said conducting elements to be situated outside of said duct; and a pair of components arranged on opposite ends of said duct for producing an axial pressure upon each of said conducting elements inserted within opposing ends of said duct to thereby allow said shoulder of each of said conducting elements to elastically deform said elastic body and to allow a continuous electric contact to be made between said contact surface of each of said conducting elements, each of said conducting elements inserted within said duct has a cross-section greater than a cross-section of said duct, said cross-section of said duct being elastically deformed by application of said axial pressure, so as to maintain said rod of said conducting elements within said elastic body.

* * * * *